United States Patent [19]

Cantelli

[11] 4,255,776

[45] Mar. 10, 1981

[54] APPARATUS FOR NEUTRALIZING ELECTROSTATIC CHARGES AND FOR REMOVING DUST FROM VARIOUS OBJECTS

[75] Inventor: Paolo Cantelli, Bologna, Italy

[73] Assignee: Fiat Srl, Bologna, Italy

[21] Appl. No.: 22,346

[22] Filed: Mar. 20, 1979

[30] Foreign Application Priority Data

Mar. 22, 1978 [IT] Italy ..... 67623 A/78

[51] Int. Cl.[3] ..... H05F 3/06

[52] U.S. Cl. ..... 361/213; 15/1.5 A; 361/220

[58] Field of Search ..... 361/212, 213, 220, 229, 361/230, 235; 132/125; 15/1.5 R, 1.5 A; 274/47

[56] References Cited

U.S. PATENT DOCUMENTS

| | | | |
|---|---|---|---|
| 3,287,614 | 11/1966 | Sowi ak | 361/235 |
| 3,355,755 | 12/1967 | Brooks | 15/1.5 |
| 3,892,247 | 7/1975 | Andersen | 361/220 X |
| 3,997,817 | 12/1976 | Secker | 361/213 |
| 4,083,073 | 4/1978 | Bernardini | 361/212 X |

FOREIGN PATENT DOCUMENTS

| | | |
|---|---|---|
| 911787 | 11/1962 | United Kingdom . |
| 1169632 | 11/1969 | United Kingdom . |
| 1195331 | 6/1970 | United Kingdom . |
| 1214962 | 12/1970 | United Kingdom . |
| 1389854 | 4/1975 | United Kingdom . |

*Primary Examiner*—Harry E. Moose, Jr.

*Attorney, Agent, or Firm*—Browdy and Neimark

[57] ABSTRACT

Disclosed herein is an apparatus for neutralizing electrostatic charges and for removing dust from various objects, comprising a trough shaped member fixed to a handle inside which a piezoelectric transducer is housed, the latter being connected electrically to an electrode located inside the trough shaped member and actuated by a pushbutton that protrudes from the handle.

14 Claims, 9 Drawing Figures

APPARATUS FOR NEUTRALIZING ELECTROSTATIC CHARGES AND FOR REMOVING DUST FROM VARIOUS OBJECTS

BACKGROUND OF THE INVENTION

This invention relates to apparatus for neutralizing electrostatic charges and for removing dust from various objects.

DESCRIPTION OF THE PRIOR ART

Apparatus of the type in question comprises:

a hollow handle inside which a piezoelectric transducer is housed;

a pushbutton that protrudes from the handle and serves to set the piezoelectric transducer in operation;

a trough shaped member carried by the handle;

a metal electrode connected electrically to the piezoelectric transducer, carried inside the trough shaped member and turned towards the opening therein.

SUMMARY OF THE INVENTION

The object of the present invention is to make available an apparatus of the aforementioned type which, compared with known apparatus, is more efficient at collecting and removing the dust.

With the apparatus according to the present invention this object is achieved thanks to the fact that the opening in the trough shaped member is sealed, at least in part, by a plate made of high dielectric constant material that can be polarized through induction at the time the piezoelectric transducer is in operation, in such a way as to attract the dust.

Because of this particular characteristic, the advantage is created of being able to fully collect and remove particles of dust, including those of very small dimensions.

According to a further characteristic of the invention, the control pushbutton is so designed that the apparatus is grounded when it is being manually operated.

The advantage is thus derived of obtaining the improved electrical efficiency of the piezoelectric transducer which, when in operation, is grounded through the human body which, as is known, has a low resistivity.

As will become apparent from the detailed description given below, the apparatus forming the subject of the present invention can be used for cleaning various types of objects by removing particles of dust or other matter from them, and some examples of possible uses are: as a comb, as a brush for items of wearing apparel or as a device for cleaning photographic negatives or other synthetic material films.

BRIEF DESCRIPTION OF THE DRAWINGS

The invention will now be described with reference to the accompanying drawings, supplied purely as an unlimited example, in which.

DESCRIPTION OF THE PREFERRED EMBODIMENT

Figure 1:
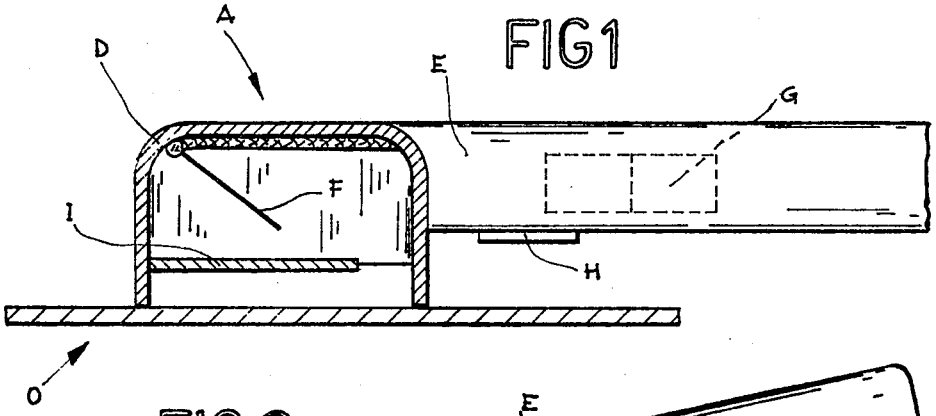
FIG. 1 is a diagrammatic view of a first preferred form of embodiment for an apparatus according to the invention.

With reference to FIG. 1, at A an electrostatic effect apparatus for collecting dust from a gramophone record O is shown.

The said apparatus A comprises a trough shaped member D fixed to a handle E in which a piezoelectric transducer G is housed.

The said piezoelectric transducer G is connected electrically to an electrode F located inside the trough shaped member D and turned towards the opening in this.

The piezoelectric transducer G can be operated, in a way in itself known, through a control pushbutton H that protrudes from the handle E.

At I there is a plate with a high dielectric constant which can be polarized through induction at the time the piezoelectric transducer G is being operated.

The plate I is so fixed to the trough shaped member D that it partially closes the opening therein, in a position displaced towards the base of the trough shaped member D with respect to the edge thereof in contact with the gramophone record O. In this configuration, the said edge of the trough shaped member D serves as a spacer between the plate I and the gramophone record O.

Figure 2:
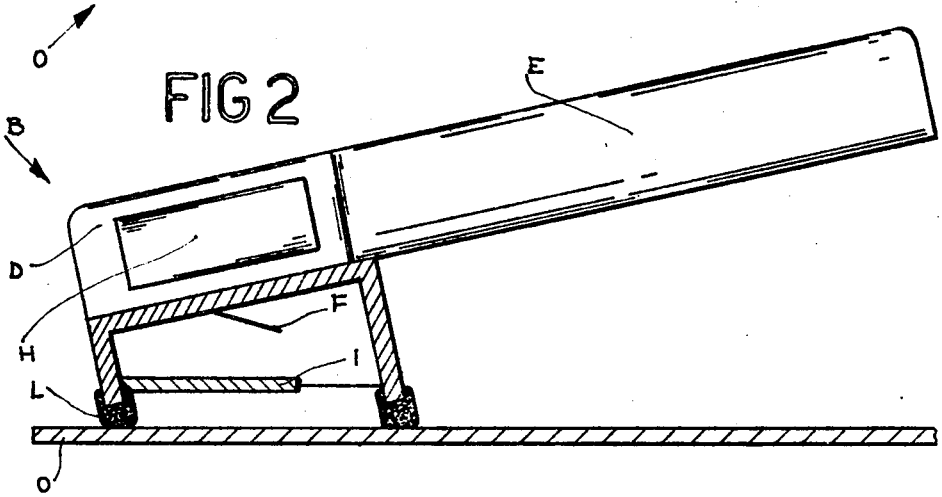
FIG. 2 is a diagrammatic view of a second preferred form of embodiment.

The apparatus shown at B in FIG. 2 is substantially similar to the apparatus A illustrated in FIG. 1, the only difference being that the plate I is on the same level as the edge of the trough shaped member D that is turned towards the gramophone record O. In this configuration, the spacer between the plate I and the gramophone record O is constituted by a soft facing L mounted along the edge of the trough shaped member D.

Figure 3:
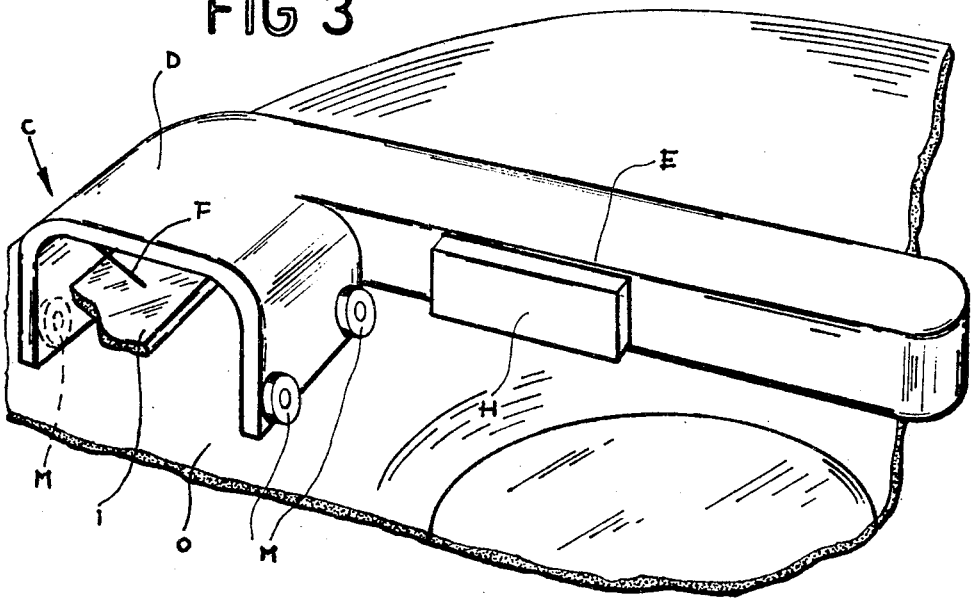
FIG. 3 is a perspective view of the apparatus according to a third preferred form of embodiment.

The apparatus shown at C in FIG. 3 differs from the apparatus B in FIG. 2 inasmuch as the spacer is constituted by a plurality of rollers M carried rotatably along a pair of edges, one opposite the other, in the trough shaped member D. Furthermore, the rollers M have the task of enabling the apparatus C to be displaced over the surface of the gramophone record O. The said apparatus C could be advantageously connected, through a control arm that is not illustrated, to an automatic device integral with the body of a record player.

Figure 4:
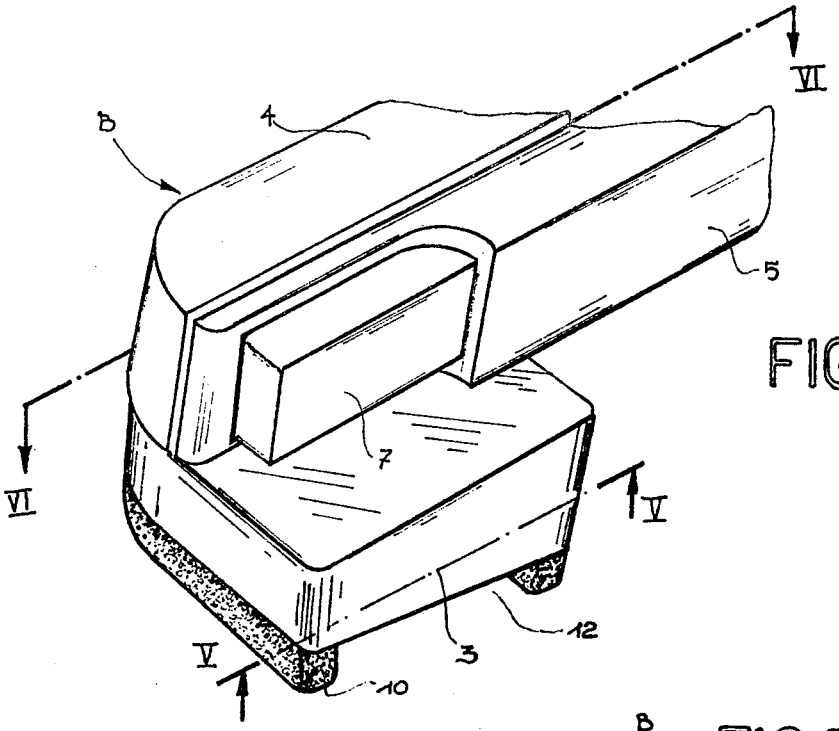
FIG. 4 is a perspective view of the apparatus illustrated in FIG. 2.
Figure 5:
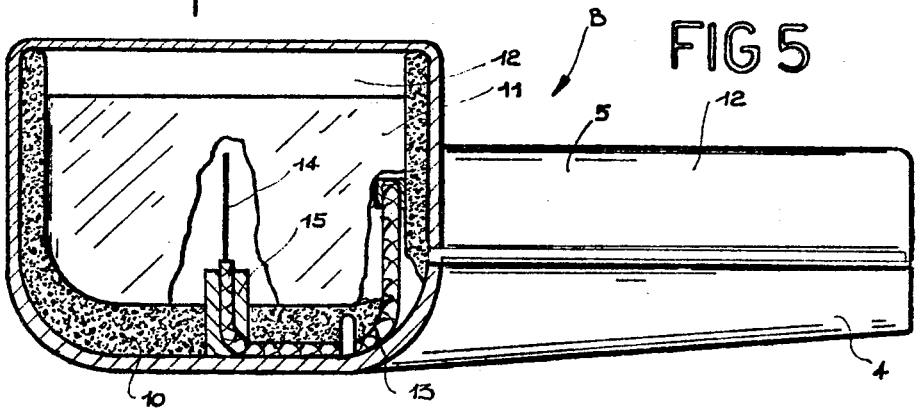
FIG. 5 is a view, partly in sectional form, along the line V—V in FIG. 4.
Figure 6:
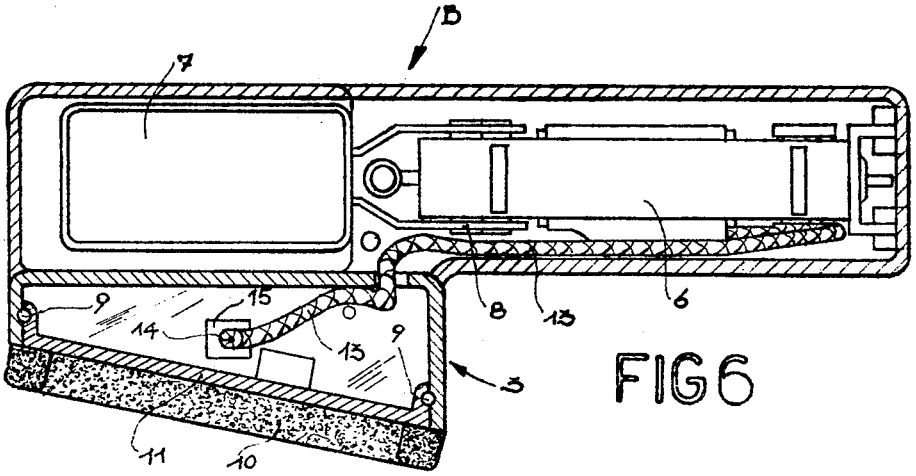
FIG. 6 is an elevational view, partly open and partly in sectional form, along the line VI—VI in FIG. 4.

The apparatus shown in FIG. 2 is illustrated in detail in FIGS. 4, 5 and 6 and it comprises a hollow handle 2 of elongated shape, one extremity of which carries a trough shaped member 3.

The hollow handle 2 is made in two parts, 4 and 5, respectively, that are connected one opposite the other in a way that allows them to be removed in order to give access to a piezoelectric transducer 6 housed in the inside of the said hollow handle 2.

At 7 a pushbutton is shown, parallelepiped in shape, protruding from one extremity of the part 5, and this is connected to the piezoelectric transducer 6 through a metal operating lever 8.

The said control pushbutton 7 is made in such a way that when the apparatus is manually operated, it is grounded through the body of the person using it. In the example illustrated, this result was achieved by using electrically conductive material, for example metallized plastic material, for making the control pushbutton 7. According to a variant that is not illustrated, the control pushbutton 7 could be made of insulating material, and its operating surface could be connected to the metal lever 8 via an electrically conductive member, for example, a copper strip or a metal connecting screw.

The trough shaped member 3 is rectangular and its depth decreases towards the extremity of the handle 2 that carries the pushbutton 7.

At 11 there is a plate secured to the trough shaped member 3 through snap-in means 9 and provided on three sides with spacer means constituted by a strip of velvet 10 provided to collect the dust together mechanically. The said plate 11 partially closes the trough shaped member 3, leaving a limited opening 12 therein, oriented parallel to the handle 2.

The plate 11 is made out of high dielectric constant material, such as celluloid, polystyrene, plexiglass or bakelite.

An electric conductor cable 13 is connected to the piezoelectric transducer 6 and it terminates at a metal electrode 14 formed like a needle. The said electrode 14 is housed inside the trough shaped member 3 and is so fixed to a support 15 that its tip is turned towards the opening 12.

The trough shaped member 3 and the handle 2 could be mechanically connected to each other in a way that would permit one to be detached from the other, so as to allow the person using the apparatus to operate, with one hand, the pushbutton 7 that protrudes from the handle 2, and to manoeuver, with the other, the trough shaped member 3 in order to collect the dust. The trough shaped member 3 and the handle 2 would naturally always be interconnected electrically through the cable 13 which would be of a suitable length. In such a case, the piezoelectric transducer 6 could even be operated by means of a pedal control (not illustrated) protruding from the handle 2 and having a connection directly with the ground.

When using the apparatus B, the pushbutton 7, pressed down slowly once the edge of the trough shaped member 3 has been placed on a gramophone record, sets the piezoelectric transducer in operation in a way that is in itself known, and this produces, through the electrode 14, local ionization of the air so as to eliminate electrostatic charges from the surface of the gramophone record to be cleaned. All attraction of the record on the particles of dust subject to electrization is, in this way, eliminated. Contemporaneously, the polarization through induction is caused of the plate 11 and this thus exerts an attraction on the minute particles of electrifiable dust which, being free, are collected by the said plate 11 while the apparatus B moves forward over the gramophone record. The mechanical dust collecting effect on the part of the velvet 10 obviously has to be added to that of the electrostatic dust collection.

Figure 7:
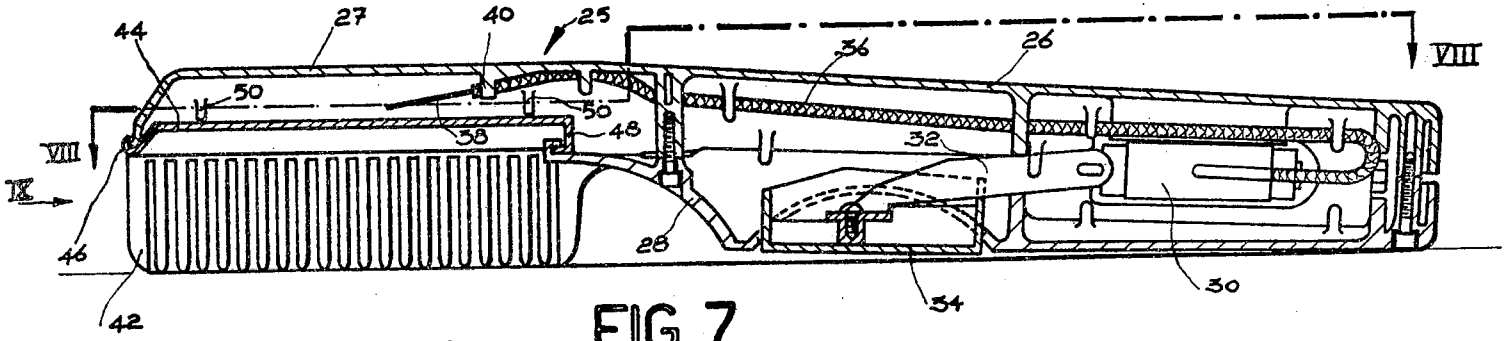
FIG. 7 is a lateral view, partly in sectional form, of a fourth preferred form of embodiment for the invention.
Figure 8:
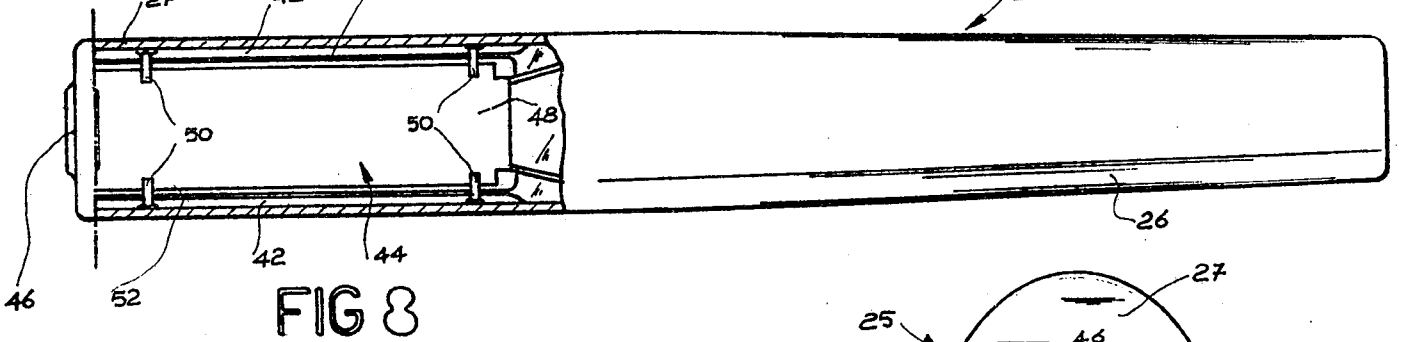
FIG. 8 is a section along the line VIII—VIII in FIG. 7.
Figure 9:
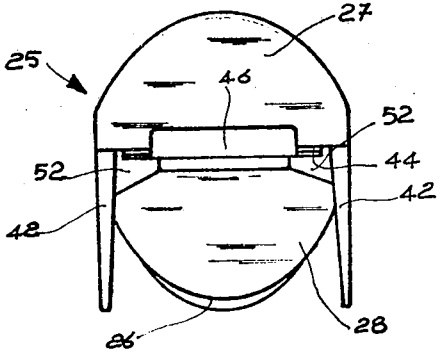
FIG. 9 is a view in the direction of the arrow IX in FIG. 7.

In the variant illustrated in FIGS. 7, 8 and 9, at 25 there is an apparatus according to the invention destined to clean the scalp.

The said apparatus 25 is constituted by an elongated cylindrical shape handle 26, connected to a semi-cylindrical trough 27 through a chamber 28.

The cylindrical handle 26 houses internally a piezoelectric transducer 30 connected, via a metal lever 32, to a control pushbutton 34.

The pushbutton 34 protrudes from the handle 26 and, just as with the pushbutton 7 for the apparatus B described with reference to FIGS. 1, 2 and 3, it is made in such a way that the apparatus 25 is grounded at the time it is being manually operated.

The piezoelectric transducer 30 is connected, through an electric cable 36, to an electrode 38 formed like a needle and fixed to a support 40 in the inside of the semi-cylindrical trough 27.

At 42 two combs are shown, one opposite the other, connected to the opposite edges of the said semi cylindrical trough 27. A plate 44 of high dielectric constant material is mounted, pressed in, between the opposite edges of the semi-cylindrical trough 27, at the base of the said combs 42.

The said snap mounting of the plate 44 is achieved through a front hooking member 46 and a rear hooking member 48 which engage with the front extreme edges of the trough 27 and with the chamfer, respectively, through the upper support members 50.

The longitudinal edges of the plate 44 and of the semi-cylindrical trough 27 are separated, one from the other, so as to delimitate two slits 52.

In use the apparatus is handled just like an ordinary comb and when the control pushbutton 34 is switched on, the piezoelectric transducer 30 polarizes the plate 44 through the electrode 38. The particles of dust and dandruff collected in the hair by the two combs 42 are attracted and gathered up by the plate 44, while the ionized air contained inside the said semi-cylindrical trough 27 overflows through the slits 52 and gives the scalp anti-bacterial treatment.

Once the combing operating has terminated, the plate 44 can be taken out of the trough 27 and cleaned.

In this case too, the handle 26 and the trough 27 could also be mechanically connected to each other in a way that would permit one to be detached from the other, leaving unchanged the electric connection through the cable 36 which, in this contingency, would be of a suitable length.

Naturally with the principles of the invention remaining unchanged, the constructional details and the forms of embodiment may be amply varied without in any way deviating from the framework of protection afforded thereto.

What is claimed is:

1. An apparatus for neutralizing electrostatic charges and for removing dust from various objects, the apparatus comprising:

a hollow handle inside which a piezoelectric transducer is housed;

a pushbutton which protrudes from said handle and is coupled to said piezoelectric transducer to set said piezoelectric transducer in operation;

a head having an opening carried by said handle and which is to contact objects to be cleaned; and at least one metal electrode connected electrically to said piezoelectric transducer, carried centrally inside said head and turned towards said opening therein; and wherein said opening in said head (D, 3, 27) is sealed at least in part by a plate (I, 11, 44) made of high dielectric constant material, said plate being disposed near and spaced from said electrode covering same and at least partially closing said opening in said head, whereby the head can be placed against an object to be cleaned without discharge from the electrode to the object.

2. An apparatus according to claim 1, wherein said plate (I, 11, 44) lies in a plane displaced towards the base of said head (D, 3, 27) with respect to an edge thereof which is to come in contact with an object to be cleaned.

3. An apparatus according to claim 1, wherein a plane in which said plate (I, 11, 44) lies at a given level as a plane tangential to an edge of said head, said head being a trough-shaped member (D, 3, 27), an edge of the latter being provided with spacers (LM, 10, 42) which are to come in contact with an object to be cleaned.

4. An apparatus according to claim 3, wherein said spacers are constituted by a continuous soft facing (L, 10) mounted on said edge of said head (D, 3).

5. An apparatus according to claim 3, wherein said spacers are constituted by individual interspaced members.

6. An apparatus according to claim 5, wherein said spacers are constituted by rollers (M).

7. An apparatus according to claim 4, wherein said continuous soft facing (L, 10) mounted on said edge of said head (D, 3) is of a nature such as to also constitute means for mechanically removing the dust.

8. An apparatus according to claim 7, destined to clean gramophone records, wherein said means for mechanically removing dust are constituted by a strip of velvet (L, 10) whereby gramophone records may be cleaned.

9. An apparatus according to claim 1, wherein to clean the scalp, an essential feature of which is that said spacer which constitute means for mechanically removing dust comprise at least one comb (42) whereby scalps may be cleaned.

10. An apparatus according to claim 9, wherein said head is a trough-shaped member (27) positioned on an extension to said handle (26), wherein said at least one comb is two combs (42), one opposite the other, fixed to opposite edges of said opening in said trough-shaped member (27), in an axial direction; and wherein said plate comprises a high dielectric constant plate (44) placed between opposite edges of said opening in said trough-shaped member (27) in the region of the base of said two combs (42).

11. An apparatus according to claim 1 or claim 2, wherein said plate (I, 11, 44) is detachably fixed in the region of at least one part of an edge of said opening in said head (D, 3, 27).

12. An apparatus according to claim 1 or claim 2, wherein said head (D, 3, and 27) is detachably fixed to said handle (E, 2, 26) which houses said piezoelectric transducer (G, 6, 30).

13. An apparatus according to claim 1 or claim 2, wherein said pushbutton (H, 7, 34) is operatively positioned and arranged so that the apparatus is grounded at times it is manually operated.

14. An apparatus according to claim 13, wherein said pushbutton (H, 7, 34) is made of electrically conductive material.

* * * * *